United States Patent [19]

Eber et al.

[11] 4,416,597

[45] Nov. 22, 1983

[54] TIP SEAL BACK-UP MEMBER FOR USE IN FLUID APPARATUS OF THE SCROLL TYPE

[75] Inventors: David H. Eber; Arthur L. Butterworth, both of La Crosse, Wis.

[73] Assignee: The Trane Company, La Crosse, Wis.

[21] Appl. No.: 478,396

[22] Filed: Mar. 24, 1983

Related U.S. Application Data

[63] Continuation of Ser. No. 232,528, Feb. 9, 1981, abandoned.

[51] Int. Cl.[3] ..... F01C 1/02; F01C 19/08; F16J 15/16; F16F 1/08

[52] U.S. Cl. ..... 418/55; 418/142; 277/204; 267/161

[58] Field of Search ..... 418/55, 142; 277/204; 267/59, 156, 161, 162

[56] References Cited

U.S. PATENT DOCUMENTS 3,400,939 9/1968 Jones ..... 418/142
3,994,636 11/1976 McCullough et al. ..... 418/55
4,080,120 3/1978 Eiermann ..... 418/142
4,199,308 4/1980 McCullough ..... 418/55

*Primary Examiner*—John J. Vrablik
*Attorney, Agent, or Firm*—Carl M. Lewis; Peter D. Ferguson; Ronald M. Anderson

[57] ABSTRACT

A tip seal back-up member is disclosed for use in fluid apparatus of the scroll type, which member comprises a strip of material extending longitudinally in generally spiroidal configuration about a reference axis and having a preformed configuration such that its radially inner and outer edge portions are disposed axially with respect to each other. The strip of material comprises an elastic material such that as one of the edge portions is displaced axially toward the other, an opposing spring force is developed. In operation, the back-up member is disposed within a groove located in a tip surface of a wrap element in fluid apparatus of the scroll type, between a bottom wall of the groove and a tip seal. Preferably, the strip of material is generally flat between its radially inner and outer edge portions and is constructed from steel.

6 Claims, 4 Drawing Figures

TIP SEAL BACK-UP MEMBER FOR USE IN FLUID APPARATUS OF THE SCROLL TYPE

This application is a continuation, of application Ser. No. 232,528, filed Feb. 9, 1981, abandoned.

DESCRIPTION

1. Technical Field

The present invention relates generally to the field of fluid apparatus of the scroll type, including compressors, pumps, and expanders; and is specifically directed to an improvement in such apparatus relating to a back-up member to be used in biasing a tip seal associated with the axial tip portions of wrap elements used in the fluid apparatus of the scroll type.

2. Background Art

In the field of positive displacement fluid apparatus, there exists a class or category generally referred to as scroll-type fluid apparatus which are characterized by the provision of wrap elements defining flank surfaces of generally spirodial configuration about respective axes, which wrap elements lie in intermeshing, angularly offset relationship with their axes generally parallel such that relative orbital motion between the wrap elements results in the formation of one or more moving volumes between the wrap elements, defined by moving lines of coaction between the wrap elements at which their flank surfaces lie substantially tangent to each other. In a preferred form, the precise shape of the generally spiroidal flank surfaces comprise an involute of a circle, however, the term "generally spiroidal" is intended to encompass any form providing the requisite moving volumes during relative orbital motion between the wrap elements. Typically, end plate means are provided in sealing relationship to the wrap elements as they undergo relative orbital motion such that the moving volumes are effectively sealed. Reference may be had to U.S. Pat. No. 801,182 for an early disclosure of scroll-type fluid apparatus embodying this principle, or to U.S. Pat. No. 3,884,599 for a more recent disclosure.

It has been recognized that scroll-type fluid apparatus have utility in a wide variety of applications, including gas compressors or vacuum pumps for elevating the pressure of a gaseous working fluid; liquid pumps for transporting a liquid working fluid; or as an expansion engine for producing mechanical work by the expansion of a relatively high pressure gaseous working fluid. In the case of a gas compressor, the moving volumes defined between warp elements originate at a radially outer portion thereof and progress inwardly while their volume is reduced, resulting in compression of the working gas which is then discharged at a radially inner portion of the wrap elements. Liquid pumps function in a similar fashion with the wrap elements configured such that no appreciable reduction in volume occurs as the volume progress radially inwardly, while scroll-type expansion engines receive a relatively high pressure gaseous working fluid at the radially inner portion of their wrap elements, which then progresses radially outwardly in the moving volumes as they increase in volume, resulting in expansion of the working fluid and production of mechanical work.

In considering the kinematic relationship necessary in order to effect the requisite relative orbital motion between the wrap elements, it should be noted that at least three general approaches exist:

(1) maintaining one wrap element fixed while orbiting the other with respect thereto, i.e., causing it to undergo circular translation while maintaining a fixed angular relationship between the wrap elements;

(2) orbiting both wrap elements in opposite directions while maintaining a fixed angular relationship therebetween; and (3) rotating both wrap elements about offset, parallel axes while maintaining a fixed angular relationship therebetween.

A second consideration relevant to the relative orbital motion between wrap elements is the manner in which their flank surfaces are permitted to coact with each other; i.e., is actual contact permitted therebetween along the lines at which the surfaces lie substantially tangent, accompanied by a radial sealing force therebetween; or are constraints imposed thereon so as to maintain a slight clearance or gap therebetween. In this regard, it is convenient to term the former as "radially compliant" type, while the latter may be refused to as "fixed-crank" type. As used herein, the term "moving line coaction" is intended to be descriptive of both types, while the term "actual moving line contact" is limited to the radially compliant type. Reference may be had to U.S. Pat. No. 3,924,977 for disclosure of a radially compliant type drive mechanism, while U.S. Pat. No. 4,082,484 is illustrative of the fixed-crank type.

Reference may be had to U.S. Pat. No. 801,182 for an early disclosure of a tip seal for use in scroll apparatus, while U.S. Pat. No. 3,994,636 is illustrative of more recent developments in this area. Moreover, applicants are aware of a further recent development in this area wherein it has been suggested that a relatively flat strip of material be provided which extends longitudinally in a generally spiroidal configuration corresponding generally to that of a groove in the tip of a wrap element for use in a fluid apparatus of the scroll type, which strip is formed so as to have a generating radius larger than that of the groove in the wrap element, requiring that the strip of material be wound into the groove and be thereby biased against a radially outer wall thereof. This has the effect of lifting the radially inner edge portion of the back-up member such that its radially inner and outer edge portions are axially disposed and such that the back-up member provides a spring force to act against a tip seal when it is axially displaced. Applicants have found that this configuration has two possible drawbacks; first, it is relatively difficult to install within the wrap element in that it must be started in the groove at a radially outer portion thereof and sequentially wound and pushed down into the groove for assembly, a second drawback being that, if a back-up member of this type is axially displaced such that it lies substantially flat in the groove, it may experience a stability problem and flip over along portions of its length such that its radially inner edge portion is then in the lower portion of the groove and the radially outer edge portion thereof is raised.

DISCLOSURE OF THE INVENTION

In accordance with the present invention, a tip seal back-up member is provided which comprises a strip of material extending longitudinally in generally spiroidal configuration about a reference axis, which strip has been preformed into a configuration such that its radially inner and outer edge portions are disposed axially with respect to each other, and which strip is constructed of an elastic material such that as one of the edge portions is displaced axially toward the other, an opposing spring force is developed. The back-up member is constructed so as to have a preformed spiroidal configuration substantially identical to that of the groove within the wrap element in which it is to be installed, permitting it to simply be dropped into place within the groove, as opposed to requiring a more complicated operation.

Accordingly, a primary object of the present invention lies in the provision of a back-up member for use in fluid apparatus of the scroll type comprising a strip of material extending longitudinally in generally spiroidal configuration and which does not experience instability problems as it is flexed due to its biasing of the tip seal member.

A further, related object of the invention is the provision of such a back-up member which is more readily assembled into its associated wrap element than prior art tip seal back-up members. These and further objects of the invention will become apparent from a consideration of the detailed description of the invention which follows and by reference to the accompanying drawings.

BEST MODE FOR CARRYING OUT THE INVENTION

Figure 1:
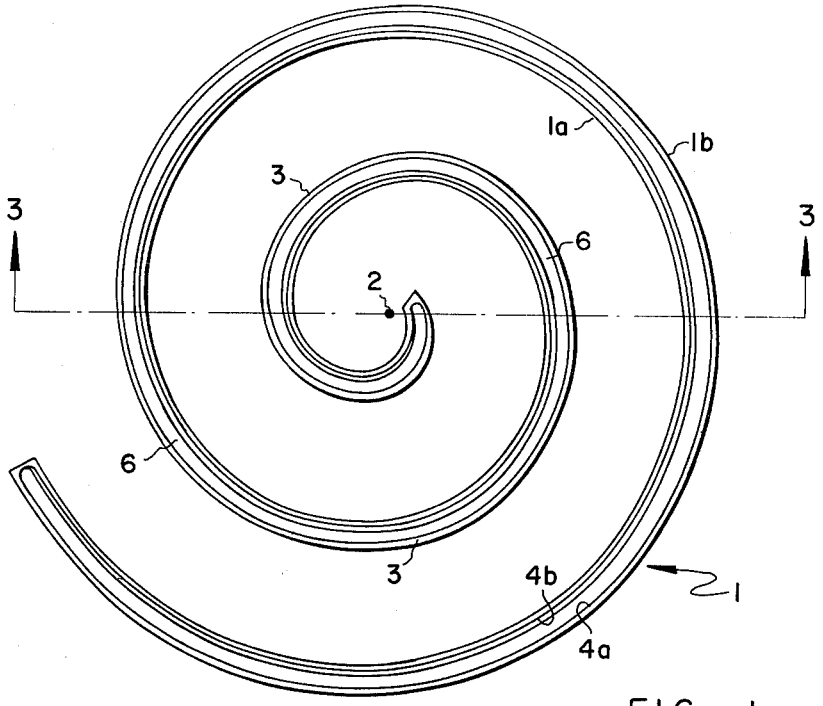
FIG. 1 is a plan view of a wrap element for use in fluid apparatus of the scroll type, including a tip seal and back-up member in accordance with the present invention.

Turning initially to FIG. 1 of the drawings, it can be seen that a wrap element indicated generally by reference numeral 1 is provided which extends in generally spiroidal configuration about a reference axis 2 and which defines first and second flank surfaces 1*a* and 1*b*, respectively, extending in an axial direction and terminating in a tip surface 3 which lies in a plane substantially perpendicular to reference axis 2. Formed within tip surface 3 is a groove 4 including a radially outer lateral wall 4*a*, radially inner lateral wall 4*b*, and a bottom wall 4*c*. Affixed to wrap element 1 is an end plate 5.

As is well known to those skilled in the art of fluid apparatus of the scroll type, scroll members comprising wrap element 1 and end plate 5 having utility in a variety of fluid apparatus. Reference may be had to the numerous references cited above for examples of such apparatus.

Figure 2:
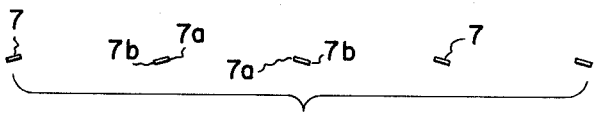
FIG. 2 is a drawing illustrating the back-up member only in overlying relationship to FIG. 3 in order to illustrate its size with respect to the wrap element into which it is assembled.

Returning then to FIG. 3, it can be seen that a back-up member 7 is disposed within groove 4 and which comprises a strip of material extending longitudinally in generally spiroidal configuration about reference axis 2, and having a preformed configuration such that its radially inner edge portion 7*a* is axially disposed with respect to radially outer edge portion 7*b*. FIG. 2 is purposefully provided in overlying relationship to FIG. 3 to illustrate the point that the configuration of back-up member 7 is, in fact, preformed and not due to any stresses imposed thereon as a result of its being disposed within the groove 4. Moreover, FIG. 2 also illustrates that the spiroidal configuration of strip 7 is preformed to be substantially identical to that of groove 4 such that it may be readily dropped into place within the groove with a minimum of interference.

Figure 3:
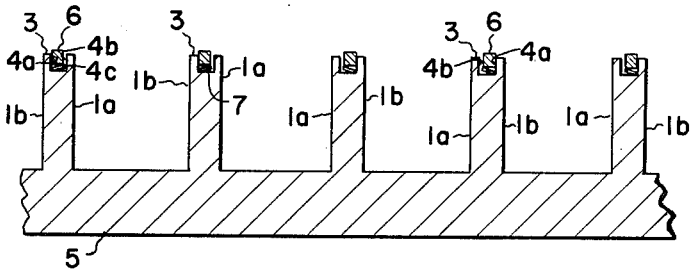
FIG. 3 is a cross section taken along the line 3—3 of FIG. 1, more clearly illustrating the tip seal and back-up member.

From a consideration of FIG. 3, it can be seen that radially inner edge portion 7*a* is susceptible to axial displacement in a downward direction (as viewed in FIG. 3), whereby an opposing spring force is developed in order to urge tip seal 6 in an upward direction, operating generally according to the principle of a "Belleville" spring.

Preferably, back-up member 7 is generally flat between its radially inner and outer edge portions as illustrated and is constructed of an elastic material such as steel so as to provide the required spring force upon displacement thereof.

Applicants have found that a back-up member of preformed configuration as described above has distinct advantages in that, not only is it much more readily assembled within groove 4 of the wrap element than prior art back-up members which require winding into the groove, but also does not experience instability problems which may be present with back-up members which relied upon their positioning within the groove for providing the necessary axial disposition between their radially inner and outer edge portions.

It should further be noted that a back-up member according to the present invention has the advantage of providing a positive secondary seal in that high pressure fluid adjacent radially inner lateral wall 1*a* is prevented from leaking under tip seal 6 continuously along its length due to presence of back-up member 7.

Figure 4:
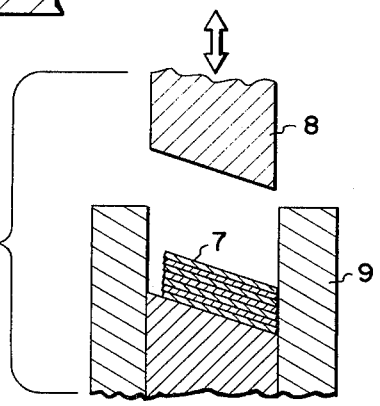
FIG. 4 is a generally schematic illustration of a die and punch combination as might be used in forming the back-up member in accordance with the present invention.

Turning now to FIG. 4 of the drawings, a punch and die fixture is illustrated which may conveniently be utilized in preforming the back-up member comprising the present invention. As shown, the fixture includes a punch member 9 and a cooperating die 9 wherein a plurality of back-up members 7 are disposed. Punch 8 is then lowered into the die in order to maintain the back-up members 7 in the positions illustrated, resulting in permanent deformation thereof in the desired shape, either through cold forming or, more preferably, through a heat treating operation. The back-up member may also be formed, although less advantageously, by forming the back-up member having a generating radius slightly larger than the groove, and winding it into the groove much as described in the prior art back-up member, and then subjecting the back-up member while so installed to a heat treating operation in order to relieve the stresses therein and cause the back-up member to remain in the desired configuration.

While the invention has been described with respect to a specific embodiment, it is to be understood that variations thereto will become apparent to those skilled in the art upon a consideration thereof. Accordingly, the scope of the invention is to be determined in accordance with the scope and spirit of the claims which follow.

We claim:

1. A wrap element with tip seal and back-up member for use in fluid apparatus of the scroll type comprising a. a wrap element defining at least a first flank surface of generally spiroidal configuration about a reference axis, said flank surface extending generally in an axial direction and terminating in a tip surface lying in a plane substantially perpendicular to said reference axis;

b,. a groove disposed within said tip surface of spiroidal configuration generally conforming to that of said flank surface, said groove including at least a radially outer lateral wall and a bottom wall;

c. a tip seal disposed at least partially within said groove and extending longitudinally about the spiroidal configuration thereof; and d. a back-up member comprising a strip of material disposed within said groove between its bottom wall and said tip seal and extending longitudinally about the spiroidal configuration of the groove, said strip of material having a preformed configuration such that its radially inner edge portion engages the tip seal and is disposed axially toward the tip surface of said wrap element with respect to the radially outer edge portion thereof, which outer edge portion engages a wall of the groove, and said strip of material being constructed of an elastic material such that as said radially inner edge portion is displaced toward the bottom wall of the groove and relative to the radially outer edge portion, an opposing spring force is developed in order to provide a seal and prevent fluid from leaking under the tip seal.

2. The wrap element with tip seal and back-up member of claim 1 wherein said strip of material has a preformed spiroidal configuration substantially identical to that of said groove.

3. The wrap element with tip seal and back-up member of claim 1 wherein said strip of material is substantially flat between its radially inner and outer edge portions.

4. The wrap element with tip seal and back-up member of claim 1 wherein said elastic material comprises steel.

5. The wrap element with tip seal and back-up member of claim 1 wherein said wrap element defines first and second flank surfaces of generally spiroidal configuration, each of which extends in an axial direction and terminates in said tip surface lying in a plane substantially perpendicular to said reference axis.

6. The wrap element with tip seal and back-up member of claim 1 wherein said groove includes radially inner and outer lateral walls, and a bottom wall.

* * * * *